United States Patent [19]

Meilenner et al.

[11] 4,426,837

[45] Jan. 24, 1984

[54] APPARATUS FOR STRANDING WIRE

[75] Inventors: Norbert J. Meilenner, St. Catharines; Richard T. Sunderland; John W. Cook, both of Kingston, all of Canada

[73] Assignee: Northern Telecom Limited, Montreal, Canada

[21] Appl. No.: 413,177

[22] Filed: Aug. 30, 1982

[51] Int. Cl.[3] ..... H01B 13/04

[52] U.S. Cl. ..... 57/293; 57/7; 57/297; 57/344

[58] Field of Search ..... 57/293, 294, 7, 13, 57/295, 297, 344

[56] References Cited

U.S. PATENT DOCUMENTS 3,847,190 11/1974 Forester ..... 57/293 X
3,910,022 10/1975 Reed ..... 57/293
4,325,214 4/1982 Zuber ..... 57/293
4,359,860 11/1982 Schleese et al. ..... 57/293

*Primary Examiner*—John Petrakes
*Attorney, Agent, or Firm*—R. J. Austin

[57] ABSTRACT

Apparatus for stranding wires and covering them in plastics insulation by providing a rotationally flexible elongate member with spaced wire guiding elements, twisting means for twisting the member alternately in opposite directions, and an extension to the elongate member, the extension lying radially within an annular extruder barrel and terminating adjacent the extrusion orifice. In an arrangement for simultaneously stranding wires into different groups and covering the groups within the same insulation, reversible driving means for two or more elongate members is mounted upon a frame. Preferably, each elongate member has its own individual driving means.

16 Claims, 7 Drawing Figures

APPARATUS FOR STRANDING WIRE

This invention relates to apparatus for stranding wires.

It is known that the twisting of wires together during their assembly offers physical and electrical advantages when used in communications or other electrical systems. For example, twisting of pairs of wires as used in telephone systems improves electrical characteristics, such as reducing crosstalk.

Conventionally, to continually twist wires together in the same direction requires a heavy movable construction as the wire spools for feeding wire into the apparatus must also revolve about the machine axis. The heavy construction limits the operational speed. To avoid the rotation of the spools, a periodically reversing twist is given to the wires and as it is desirable to twist long lengths of wires, accumulators become necessary.

In order to overcome problems with known twisting apparatus, simplified apparatus has been devised to give a periodic reverse twisting operation. This simplified apparatus, as described in U.S. Pat. No. 3,910,022 granted Oct. 7, 1975 in the name of Phillip John Reed and entitled "Apparatus For Stranding Wires," involves the use of a tubular member one end of which is held stationary and the other twisted first in one direction and then the other. Dividers positioned along the tube form separate paths for wires passing down the tube and a twisting means at a tube outlet places the reverse twist in the wires.

The invention described in the above patent has a certain disadvantage in that it is difficult to thread or pass wires in their correct positions down the tubular member and this procedure is a tedious and time consuming operation. If the tube is formed of transparent plastic to give visual aid to wire threading, the transparency is lost after a short period of use due to impurities deposited upon the tube surface and due to changes in the plastic itself.

The above disadvantages of wire threading has been overcome by apparatus described in U.S. Pat. No. 4,325,214 granted Apr. 20, 1982, in the name of Bretislav Panel Zuber and entitled "Apparatus For Stranding Wire." In this patent, the tubular member is replaced by an elongate member which is held stationary at an upstream end and is rotatable at its downstream end for twisting it. A plurality of wire guiding elements extend radially outwards from the elongate member and have wire guiding holes whereby the wires are threaded through the holes from guiding element to guiding element while being located outwards from the elongate member. Thus the wires are completely accessible and are visible during the threading procedure.

According to the present invention there is provided a practical apparatus for stranding wires with a recovering twist and for covering them with an insulation material.

The present invention is concerned in one aspect with apparatus for stranding and covering wires comprising an elongate member having a longitudinal axis, being rotationally flexible about said axis to enable it to be torsionally twisted in alternating directions, and defining a plurality of feedpaths for wires along the member; holding means for holding the elongate member stationary at a position upstream of the wire guiding elements; wire twisting means secured to the elongate member and defining a plurality of angularly spaced and longitudinally extending holes, one for each of the feedpaths; rotating means for rotating the twisting means together with a downstream portion of the elongate member for a predetermined number of revolutions about the axis alternately in one direction and then the other; an extension of the elongate member extending downstream from the rotating means to ensure that stranding together of wires is avoided until wires pass from a downsteam end of the extension; and an extruder for plastic insulation for stranded wires, the extruder having an annular barrel extending along and surrounding the extension, and extending radially inwards at an outlet end to define an extrusion orifice adjacent to and immediately downstream from the downstream end of the extension.

It is preferable that the extension is a tube. The twisting means is conveniently close to the position of the rotating means along the guide paths of the wires. However, the twisting means may be at a downstream end of the extension and thus in this case, the twisting means prevents the torsionally twisted wires from stranding together until they have passed through the twisting means. When the twisting means are close to the rotating means, the extension is provided with means separate from the twisting means to ensure that the torsionally twisted wires are not stranded together between the twisting means and the downstream end of the extension.

According to another aspect of the invention, apparatus for stranding and covering wires comprises a plurality of elongate members, each having:

(a) a longitudinal axis being rotationally flexible about said axis to enable it to be torsionally twisted in alternating directions, and defining a plurality of feedpaths for wires along the member;

(b) holding means for holding the elongate member stationary at a position upstream of the wire guiding elements, (c) wire twisting means rotatable with a downstream end of the elongate member and defining a plurality of angularly spaced and longitudinally extending holes, one for each of the feedpaths, (d) rotating means for rotating the twisting means together with the downstream end of the elongate member for a predetermined number of revolutions about the axis alternating in one direction and then the other;

(e) a frame means holding the wire twisting means and the rotating means and with the elongate members being disposed to locate the guide paths for the wires through openings defined in the frame; and (f) reversible driving means mounted upon the frame and drivably connected to the rotating means of the elongate members.

Embodiments of the invention will now be described by way of example, with reference to the accompanying drawings in which.

Figure 1:
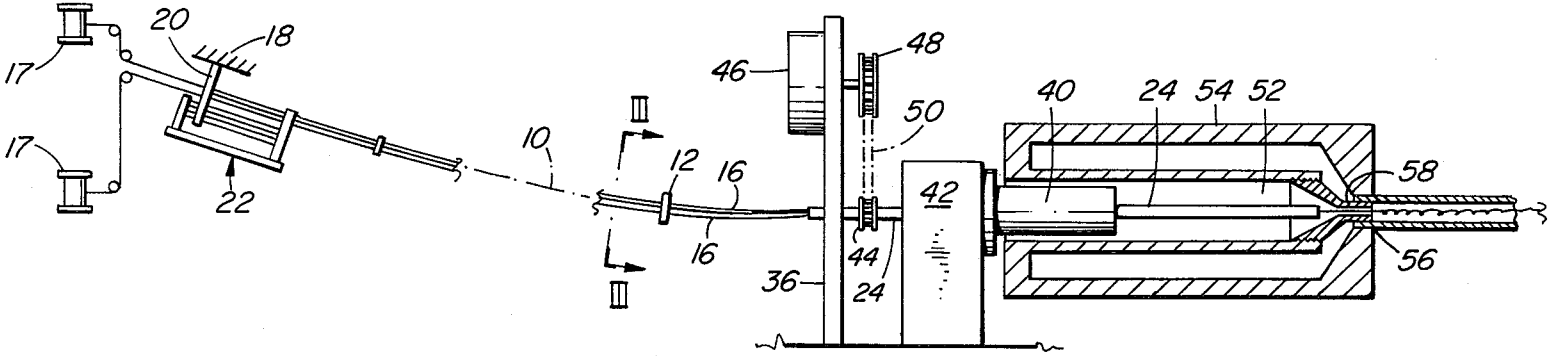
FIG. 1 is a side elevational view of a first embodiment, partly in section.

In a first embodiment shown in FIG. 1, apparatus for stranding and covering wire comprises an elongate member 10 having a longitudinal axis and a plurality of wire guiding elements 12 in the form of discs secured to the member 10 in longitudinally spaced-apart positions. The member 10 passes through a concentric hole in each disc and each disc is formed with guide holes 14 angularly spaced apart around the longitudinal axis, one hole 14 for each of a plurality of wires 16 which are to be stranded together. As there are two wires to be stranded, there are two holes 14 in each disc, diametrically opposed across the member 10. Guide or feed-paths are thus provided for the wires from spools 17 and through corresponding holes from one element 12 to another.

The elongate member 10, which may be constructed as a steel rod or a cable of composite plastic construction, for instance as described in above-mentioned U.S. Pat. No. 4,325,214 is rotationally flexible about its longitudinal axis. The member 10 is held stationary in a frame (shown diagrammatically at 18) at an upstream end, when considered in the sense of direction of wire movement, by a holding means which may be a wire clamping block 20 secured to the frame. Alternatively to reduce residual tension or to take up any slack in the member 10 caused by stretch during use, the holding means may either comprise a counterweight such as is described in the above-mentioned U.S. Pat. No. 4,325,214, or the clamping block itself is spring-loaded in the frame. The apparatus of the first embodiment also includes means for changing the direction of rotation of the downstream end of member 10 after a predetermined number of rotations in one direction or the other. This direction changing means 22 is disposed towards the upstream end of the member 10 and is constructed in accordance with the direction changing means described in the U.S. patent application Ser. No. 413,178, filed concurrently with this present application in the names of John Nicholas Garner, Jean Marc Roberge and Norbert Meilenner, and entitled "Apparatus for Stranding Wire".

Figure 4:
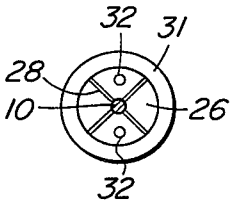
FIG. 4 is a cross-sectional view taken along line 'IV—IV' in FIG. 2.
Figure 2:
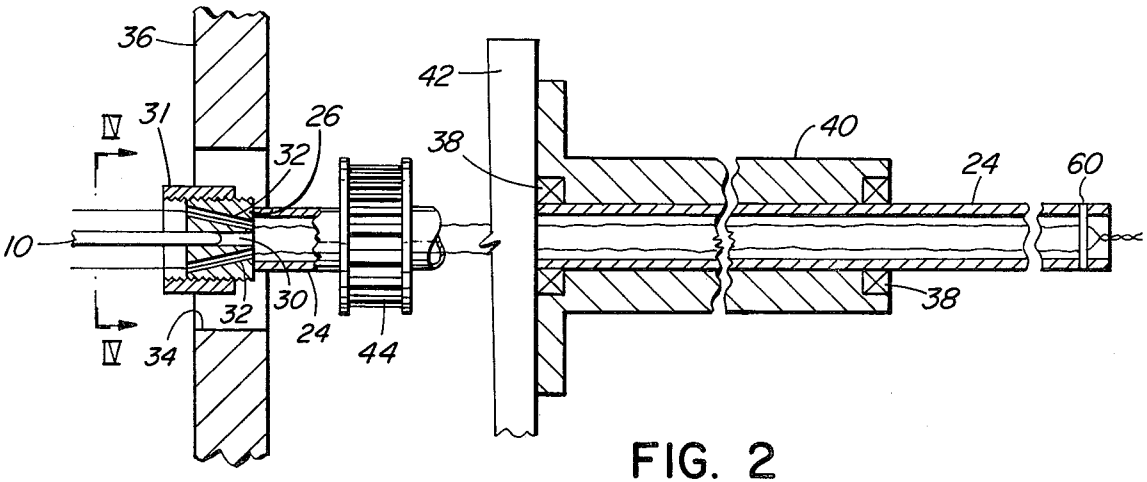
FIG. 2 is a sectional view along the axis of part of the apparatus of FIG. 1 and on a larger scale.

At the downstream end of the member 10, it is secured to a downstream extension in the form of a tube 24 (FIG. 2). A thick collar 26 is brazed or otherwise attached to the upper end of the tube. As shown in FIG. 4, the thick collar provides a wire twisting means for the member 10, and to this end is formed for part of its length with a plurality of radial slits 28 (namely four) from its outer surface to a central aperture 30. The upstream end of the collar is thus formed into segments by the slits. These segments are collapsed radially inwards sufficient to grip the downstream end of member 10 passing through the aperture 30, by a narrowing of the slits, caused by a tapered screw-threaded means between the outside of the collar and a nut 31 received thereon. Conveniently, the screw thread in the nut is slightly tapered to cause a greater gripping action as the nut is tightened upon the collar.

Figure 3:
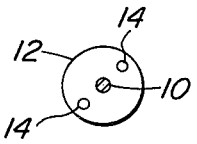
FIG. 3 is a cross-sectional view of the apparatus taken along line 'III—III' in FIG. 1.

As may be seen from FIGS. 2 and 3, the collar 26 has two opposed holes 32 through which the wires 16 pass and then into the tube 24.

The upstream end region of the tube is located through a clearance hole 34 in a vertical frame 36. The tube is supported downstream from frame 36 by axially spaced bearings 38 carried in a hollow elongate support 40 held as a cantilever at an upstream end by frame member 42.

Rotating means is provided for rotating the tube 24 and the twisting means or collar 26 for a predetermined number of revolutions about the longitudinal axis alternately in one direction and then the other. As shown by FIGS. 1 and 2, this rotating means comprises a peripherally toothed wheel 44 which is secured to the tube in a position between the frame 36 and frame member 42.

Driving means drivably connected to the rotating means comprises a low inerta DC motor 46 mounted upon an upstream face of the frame 36. The motor is reversible and is of a type known as "pancake" motor such as sold by Mavilor Motors, Hartford, Conn. under model no. MOA-600. It is imperative that the reversing time of the motor is as short as possible to restrict the lengths of stranded wire which extend between change-over positions from one direction of twist to the other. In this particular motor, it is estimated that reversal time is about 40 to 60 milliseconds. The driving means also includes a peripherally toothed pulley wheel 48 on the drive shaft of the motor and a toothed pulley belt 50 extending around and is mesh with the pulley wheels 44 and 48.

The tube 24 and its elongate support 40 are disposed radially within an annular barrel 52 of a plastics extruder 54. The tube 24 protrudes beyond the support 40 to terminate adjacent to an annular extrusion orifice 56 of the extruder, the word "adjacent" in this sense meaning a distance insufficient to allow for any significant unstranding of wires after they have emerged from the tube and before they are covered with a layer of plastic insulation by the extruder. This distance may be of the order of up to 5 or more inches.

The extruder is provided for forming a tube around the wires with sufficient interference between the tube and wires to prevent them from becoming unstranded. To this end, the extruder has a tubing sleeve 58 defining the inner surface of the orifice 56 and through which the stranded wires pass. Alternatively, in a construction not shown, the tubing sleeve is not used and plastic is extruded from the orifice so as to embed the stranded wires firmly within it so that no distinct tube of insulation is formed.

The tube 24 has as its primary purpose to avoid the wires 16 from stranding together until they have passed through the downstream end of the tube whereby the distance from the stranding position to the extrusion orifice is maintained as small as possible as referred to above. Prevention of stranding within the tube is provided by a passage defining means in the form of a diametral rod 60 to form two passages, one on each side of the rod for each of the wires.

In use of the apparatus of the first embodiment, the wires 16 are passed, as shown, through the holes 14 from one guiding element 12 to another, through the holes 32 in collar 26, along the tube and one on each side of the rod 60.

Under the control of the direction changing means 22, the motor 46 rotates alternately in its two directions to torsionally twist the elongate member 10 alternately in each direction. This effects a twist in periodically reversing manner in the two wires which are held apart diametrically on each side of the elongate member.

Actual twist upon the wires is caused by the collar 26. The wires after passing through the holes 32 in the collar are held apart, so as to remain unstranded, along the length of tube 24 by the rod 60.

The torsional twist in the wires then causes them to strand together with alternating direction of lay when their paths are less restrained downstream of the rod 60. The stranded wires are fed through the sleeve 58 of the extruder to become enclosed within a tube layer 62 of plastic insulation. This grips the wires sufficiently to prevent their untwisting.

The insulated and stranded wires then pass onto a reeling drum or through some other process stage which provides the pulling action to unreel the wires.

The above described embodiment is an extremely practical method of stranding and insulating wires in cable manufacture. In this embodiment, two wires are stranded together and are useful as cable pairs in telecommunications cables. Because of the use of the extension to the elongate member, the wires are located as close as is physically possible to the extruder orifice before they are permitted to strand together whereby they are held securely by the extruded insulation before having any opportunity for becoming unstranded particularly at their lay direction changeover positions. Also, the apparatus is of simple construction to perform its task of stranding and insulating as compared to conventional apparatus which involves use of heavy and cumbersome machinery parts.

The apparatus according to the invention is not limited for stranding and covering of two wires. For instance, as shown by the second embodiment, three pairs of wires are stranded together in their pairs and the pairs are brought together for the insulation stage.

In the second embodiment now to be described, parts bearing the same reference numerals as in the first embodiment are of identical or similar construction.

Figure 5:
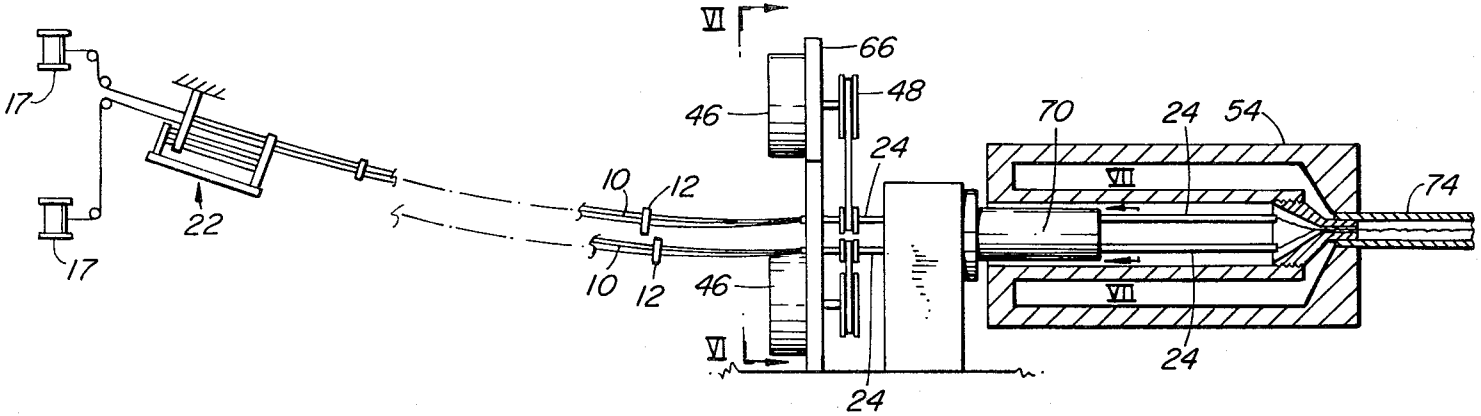
FIG. 5 is a side elevational view of a second embodiment, partly in section.
Figure 7:
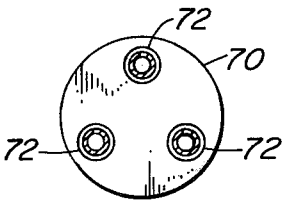
FIG. 7 is a cross-sectional view of the second embodiment taken along line 'VII—VII' in FIG. 5 and on a larger scale.
Figure 6:
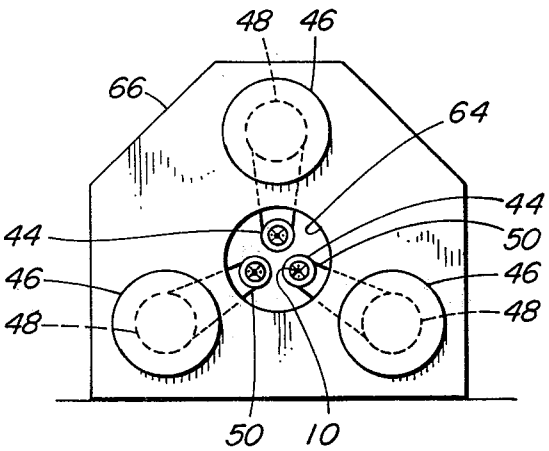
FIG. 6 is a cross-sectional view of the second embodiment taken along line 'VI—VI' in FIG. 5 and on a larger scale.

In the second embodiment, shown in FIGS. 5 and 6, three elongate members 10, each carrying wire guiding elements 12, extend substantially side-by-side from their fixed upper ends 18, each member 10 having direction changing means 22 as described in the first embodiment. For simplicity one only of the upper ends of the members 10 is shown together with its associated equipment. The members 10 are secured at their downstream ends to tubes 24 in exactly the manner described in the first embodiment. Upper ends of the tubes are located within a clearance hole 64 of a vertical frame 66. FIG. 5 shows only two members 10 and tubes 24 because as is clear from FIGS. 6 and 7, the lower members and tubes are superimposed in FIG. 5. The tubes are held in side-by-side relationship by being carried separately in axially spaced bearings in parallel passages formed in an elongate support 70. FIG. 7 shows the relationship of the tubes at their downstream ends with one bearing 72 for each tube. As may be seen from FIG. 5, with the tubes sufficiently close together, the support 70 and the tubes are locatable radially within the annular extruder 54 with their downstream ends adjacent the extrusion orifice for insulation purposes.

Driving means for driving the rotating means of each elongate member 10 comprises a low inertia DC motor 46. As may be seen from FIG. 6, a separate motor and pulley belt 50 is provided for each member 10, the motors being positioned substantially equally spaced apart around the clearance hole 64. The use of three separate motors enables the individual direction changing means 22 to change the direction of rotation of its individual motor when it has torsionally twisted its elongate member the desired number of times in each direction to impart the appropriate twist to its wires. Thus the elongate members 10 have their twist controlled individually. Alternatively, the three members 10 are twisted together by one driving means. A difficulty here in a practical sense, is that if the twist of one of the elongate members is out of phase with the others, then this member will be twisted more in one direction than the other whereby the eventual twist of the wires passing along that member will be more in one direction than the other. The use of separate driving means and direction changing means 22 does not permit this to occur as each motor changes direction independently of the directional change of the other motors.

In use of the second embodiment, two wires are fed through the holes 14 along each elongate member and pass through the twisting means of that member and along tube 24 as described in the first embodiment. The motors 46 operate to place torsional twist in the wires and upon leaving the tubes 24, the wires from each member become stranded together and the three pairs of stranded wires are passed through the extruder orifice for covering with an extruded layer 74 of plastics insulation.

The second embodiment illustrates the compact nature of a design having separate drive motors placed around a centralized grouping of tubes for twisting wires and then for bringing the twisted wires together at an extrusion orifice.

What is claimed is:

1. Apparatus for stranding and covering wires comprising:

(a) an elongate member having a longitudinal axis, being rotationally flexible about said axis to enable it to be torsionally twisted in alternating directions, and defining a plurality of feedpaths for wires along the member;

(b) holding means for holding the elongate member stationary at a position upstream of the wire guiding elements;

(c) wire twisting means rotatable with a downstream end of the elongate member and defining a plurality of angularly spaced and longitudinally extending holes, one for each of the paths;

(d) rotating means for rotating the twisting means together with the downstream end of the elongate member for a predetermined number of revolutions about the axis alternatively in one direction and then the other;

(e) an extension of the elongate member extending downstream from the rotating means to ensure stranding together of twisted wires is avoided until wires pass at least into a downstream end part of the extension; and (f) an extruder for plastic insulation for stranded wires, the extruder having an annular barrel extending along and surrounding the extension and extending radially inwards of an outlet end to define an annular extrusion orifice around a feed path for stranded wires and adjacent to and immediately downstream from the downstream end of the extension.

2. Apparatus according to claim 1, wherein the extension is a tube.

3. Apparatus according to claim 1, wherein the elongate member has wire guiding elements extending radially outwardly therefrom with wire guiding holes defined in each wire guiding element around and outwardly from the elongate member, a downstream end of the elongate member secured to an upper end of a tube with the twisting means associated with the tube, and the rotating means secured to the tube with part of the tube extending downstream from the rotating means to form the extension.

4. Apparatus according to claim 3, wherein a radially collapsable collar surrounds the downstream end of the elongate member, a nut coacting with the collar by a tapered screw thread means holding the collar secured to the upper end of the tube and formed with holes for passage of the wires into and along the tube, the collar forming the wire twisting means to torsionally twist the wires, and the tube having passage defining means for individual wires at a downstream end part of the tube to prevent twisted wires from stranding together between the twisting means and the downstream end of the tube.

5. Apparatus according to claim 4, wherein the collar is formed with radial slits to form the collar into segments, the segments being collapsed inwardly together by the nut to grip the elongate member.

6. Apparatus according to any of claims 3 and 4 wherein the tube is rotatably mounted in bearings to enable the twisting means and the downstream end of the elongate member to be rotated.

7. Apparatus according to claim 6, wherein the tube is mounted in bearings at said extension whereby the rotating means is disposed upstream of the bearings.

8. Apparatus according to claim 7, wherein an elongate support for the tube is provided downstream of the rotating means, the elongate support being surrounded by the extruder barrel and the tube extending from the downstream end of the support.

9. Apparatus according to claim 7, wherein at least two elongate members are provided, each having wire guiding elements, holding means and wire twisting means, the two elongate members having downstream ends secured to upper ends of tubes, one tube to each member, the at least two tubes extending in side-by-side and parallel relationship through the elongate support and being individually carried by bearings in the support.

10. Apparatus according to claim 9, wherein the at least two elongate members each have independent, reversible driving means drivably connected to the rotating means, the driving means being mounted upon a frame in spaced apart positions around an opening through the frame and each assembly of elongate member and its extension being disposed through the opening.

11. Apparatus for stranding and covering wires comprising:

a plurality of elongate members, each having (a) a longitudinal axis, being rotationally flexible about said axis to enable it to be torsionally twisted in alternating directions, and defining a plurality of feedpaths for wires along the member;

(b) holding means for holding the elongate member stationary at a position upstream of the wire guiding elements;

(c) wire twisting means rotatable with a downstream end of the elongate member and defining a plurality of angularly spaced and longitudinally extending holes, one for each of the feedpaths;

(d) rotating means for rotating the twisting means together with the downstream end of the elongate member for a predetermined number of revolutions about the axis alternately in one direction and then the other;

(e) a frame means holding the wire twisting means and the rotating means and with the elongate members being disposed to locate the guide paths for the wires through openings defined in the frame; and (f) reversible driving means mounted upon the frame and drivably connected to the rotating means of the elongate members.

12. Apparatus according to claim 11, wherein the elongate members each has an extension extending downstream from the rotating means to ensure stranding together of the wires is avoided until wires pass from the downstream end of the extension.

13. Apparatus according to claim 12, wherein the twisting means is disposed at an upper end of the extension and the extension has passage defining means for individual wires at a downstream end part of the extension to prevent torsionally twisted wires from stranding together between the twisting means and the downstream end of the extension.

14. Apparatus according to claim 11, wherein the elongate members each has an individual driving means connected to its rotating means, each driving means being controllable for rotating the twisting means and its elongate member and for reversing direction of rotation independently of the other driving means.

15. Apparatus according to claim 14, wherein each driving means comprises a low inertia DC motor mounted upon the frame and drivably connected to its associated rotating means.

16. Apparatus according to claim 15, wherein the driving means for each rotating means is drivably connected to its driving means by a pulley belt formed with drive teeth on its inner peripheral surface, and the driving means and rotating means are each provided with a pulley wheel provided with teeth, the pulley wheels being in mesh with the teeth of the pulley belt.

* * * * *